US008286812B2

(12) United States Patent
Buczkowski

(10) Patent No.: US 8,286,812 B2
(45) Date of Patent: Oct. 16, 2012

(54) DEVICE AND METHOD FOR IRREVERSIBLY SELECTING INDICIA

(76) Inventor: Andrzej Buczkowski, Elizabeth, NJ (US)

( * ) Notice: Subject to any disclaimer, the term of this patent is extended or adjusted under 35 U.S.C. 154(b) by 1171 days.

(21) Appl. No.: 12/101,300

(22) Filed: Apr. 11, 2008

(65) Prior Publication Data

US 2009/0255897 A1 Oct. 15, 2009

(51) Int. Cl.
*B65D 41/00* (2006.01)

(52) U.S. Cl. ..... 215/230; 215/219; 215/220; 220/253; 220/254.1; 220/256.1

(58) Field of Classification Search ..... 215/219, 215/220, 230; 220/253, 254.1, 256.1
See application file for complete search history.

(56) References Cited

U.S. PATENT DOCUMENTS

| | | | | |
|---|---|---|---|---|
| 4,347,804 | A | 9/1982 | Villa-Real | |
| 4,365,722 | A * | 12/1982 | Kramer | 215/220 |
| 4,433,789 | A | 2/1984 | Gibilisco | |
| 4,489,841 | A | 12/1984 | Thompson | |
| 4,666,051 | A | 5/1987 | Trick | |
| 4,854,459 | A * | 8/1989 | DeJonge | 215/220 |
| 4,862,560 | A | 9/1989 | Lichtenberg | |
| 4,862,561 | A | 9/1989 | Lichtenberg | |
| 4,941,573 | A | 7/1990 | Fuerstman | |
| 5,011,032 | A | 4/1991 | Rollman | |
| 5,299,701 | A | 4/1994 | Barker et al. | |
| 5,704,144 | A | 1/1998 | Groth | |
| 5,730,292 | A | 3/1998 | Jones | |
| 6,003,467 | A | 12/1999 | Shelton-Ferrell et al. | |
| 6,059,133 | A | 5/2000 | Lai | |
| 6,082,030 | A | 7/2000 | Kesselring et al. | |
| 6,086,702 | A | 7/2000 | Rea | |
| 6,604,650 | B2 | 8/2003 | Sagar | |
| 6,745,505 | B2 | 6/2004 | Moran | |
| 7,000,791 | B2 | 2/2006 | Miller | |
| 7,100,530 | B2 | 9/2006 | Lu | |
| 7,222,736 | B1 | 5/2007 | Seijas | |

FOREIGN PATENT DOCUMENTS

| | | |
|---|---|---|
| EP | 1413526 A1 | 4/2004 |
| GB | 2397294 A | 7/2004 |
| WO | WO2005/049443 | 6/2005 |

* cited by examiner

*Primary Examiner* — Anthony Stashick
*Assistant Examiner* — Elizabeth Volz
(74) *Attorney, Agent, or Firm* — Michael J Feigin, Esq.; Feigin & Associates, LLC

(57) ABSTRACT

The invention disclosed is a cap or other device and method of using same, the device comprising at least a first and second member, the cap having a first configuration in which the first and second members are rotatably connected to each other, and a second configuration in which the first and second members are fixed to each other. The second configuration is substantially irreversible, such that the device cannot be reverted to the first configuration without the aid of tools, breaking the device, or causing the device to lose functionality.

19 Claims, 12 Drawing Sheets

DEVICE AND METHOD FOR IRREVERSIBLY SELECTING INDICIA

BACKGROUND OF THE INVENTION

When consumers purchase products, such as drinks, in disposable containers, there is currently no simple and quick method for differentiating between the various containers. For example, if a mother buys a six-pack of bottled water for the family, or a coach purchases dozens of bottles of a sports drink for a team, all the bottles are typically identical. The consumer, for example a child or a team member, does not always drink the entire contents of the bottle immediately or may eventually refill the bottle.

However, when, for instance, the bottles are left in the refrigerator, on a countertop, or on the side of a field, and the prior drinker from one of the bottles returns, it is difficult to determine which bottle belongs to the drinker. While it is possible to mark up the bottle in some way, this is not always practical or remembered, and any indicia placed on the bottle may come off, be inconsistent, or not noticed by another drinker. The problem is especially acute when one of the drinkers is sick or the bottle contains medicine. In such cases, it is extremely important to match up the bottle with the prior drinker or owner, in order to prevent the spread of germs and/or to ensure that the correct dosage of medicine is ingested.

While various inventions exist to allow for the selection of indicia on a bottle, such inventions provide indicators which can be willfully changed and/or are not suitable for exhibiting a selectable display of ownership. For example, U.S. Pat. No. 5,299,701 to Barker et al. teaches an indicator cap where a number is selectable; however, the cap is designed for frequent number changes. In another example, U.S. Pat. No. 6,059,133 to Lai teaches a cap with selectable shapes or numbers where, again, the selection may be freely altered. These inventions and others lack the ability to designate an owner throughout the usage of the bottle, without fear of another person simply re-designating ownership.

Thus, there is a need for a device which is inexpensive to manufacture and procure that can be placed on bottles and other objects of limited duration use, by which ownership, purpose of use, or other indicia may be selected to prevent others from changing the ownership designation.

SUMMARY OF THE INVENTION

It is therefore an object of the invention to provide a method and device to irreversibly display an indicium, such as a color, on a device such as a bottle cap during the duration of usage of the device or bottle.

In embodiments of the invention, the cap has at least a first and a second member, each member having an adjacent side and an opposing side with respect to said other member. The cap has a first configuration in which the first and second members are rotatably connected to each other, and a second configuration in which the first and second members are fixed to each other, the second configuration being substantially irreversible. In the second configuration, one or more indicia may be displayed through an aperture on the first member.

The cap may further comprise at least one ring having a lip configured for substantially irreversible engagement with said second member. The ring/lip comprises a region substantially parallel to the generally flat, longitudinal plane of the second member, causing a cap in the second configuration to remain in the second configuration. The adjacent side of the first member may still further comprise a plurality of protruding wedges spaced apart by a plurality of grooves. The adjacent side of the second member may further comprise a plurality of pits spaced apart by a plurality of vanes substantially corresponding to the wedges and ridges of the first member. The second configuration may be substantially irreversibly engaged upon pressing the wedges into the pits and the grooves into the vanes.

The first member may comprise a perpendicularly extending lip, extending from the adjacent side off the substantially longitudinal plane of the first member, the lip comprising the aperture.

A device for irreversibly exhibiting one of a plurality of indicia is also claimed. The device may comprise a first and second member, each said first and second member having an adjacent and an opposing side with respect to the other member, the second member comprising a plurality of indicia on the adjacent side, and the first member comprising an aperture adapted for exhibiting one said indicium. The device comprises a first and second configuration: a first configuration wherein the first and second members are rotatably connected to each other, and a second configuration wherein the first and second members are substantially irreversibly fixed to each other and one said indicium is exhibited through said aperture.

The device may comprise at least a part of a bottle cap. A first or second member may comprise at least one neck, the neck terminating at a tip, the tip extending substantially perpendicularly to the neck and having a flat side causing the device to remain in the second configuration. The first member may further comprise a plurality of wedges configured for placement into a plurality of corresponding pits of the second member as the device enters the second configuration. The plurality of wedges and the plurality of corresponding pits may be aligned in a manner such that in the second configuration the first member and the second member are fixed with respect to each other and one indicium is exhibited through the aperture.

A method of selecting an irreversibly displayed indicium is also disclosed, comprising the steps of rotating a first member until a desired indicium is exhibited through an aperture in the first member, and applying pressure on the first member toward the second member, wherein the first member and the second member become irreversibly locked in place and one indicium on the second member is exhibited through an aperture of the first member.

DETAILED DESCRIPTION

The invention disclosed is a cap, or other device and method of using same, the device comprising at least a first and second member, each first and second member having an adjacent side and an opposing side with respect to the other member, the cap having a first configuration in which the first and second members are rotatably connected to each other, and a second configuration in which the first and second members are fixed to each other. The second configuration is substantially irreversible, meaning that when the device is in the second configuration, it cannot be reverted to the first configuration without the aid of tools, breaking the device, or causing the device to lose functionality. "Substantially irreversible" may also be defined as what a reasonable person would consider far beyond the amount of force used to open and close a bottle or cause the device to enter the second configuration from the first configuration.

The device may also include a plurality of indicia placed on the second member and exhibited through an aperture of the first member. Entering of the second configuration may take place only when a single indicium is exhibited and this indicium may be a color.

The invention will become more comprehensible in light of the figures and description thereof provided below.

Figure 1:
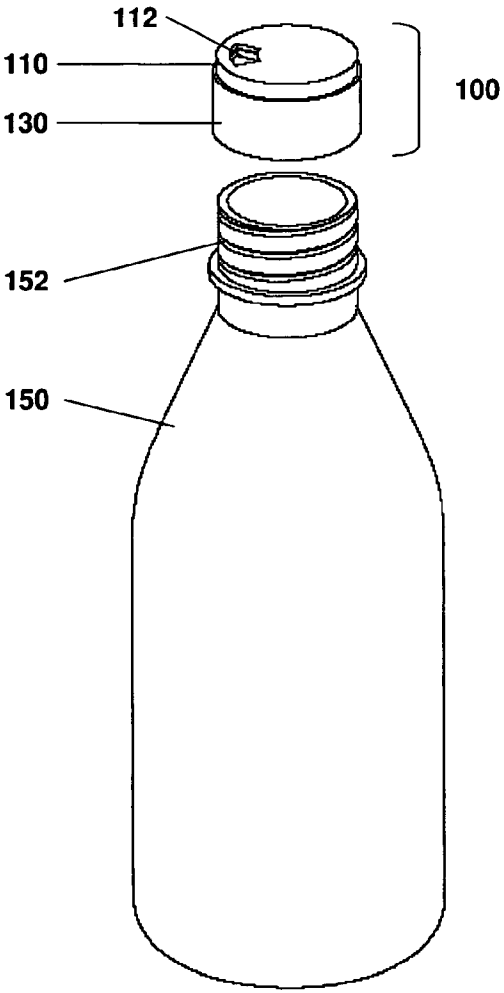
FIG. 1 shows a side elevation view of a cap and bottle used in an embodiment of the invention.

FIG. 1 shows a side elevation view of a cap and bottle used in an embodiment of the invention. In this embodiment, the first member 110 of the cap 100 is situated above the second member 130. An aperture 112 on the first member allows for exhibiting of indicia on the second member 130. The cap has threads (not visible) for engagement with the threads 152 of the bottle 150.

Figure 2:
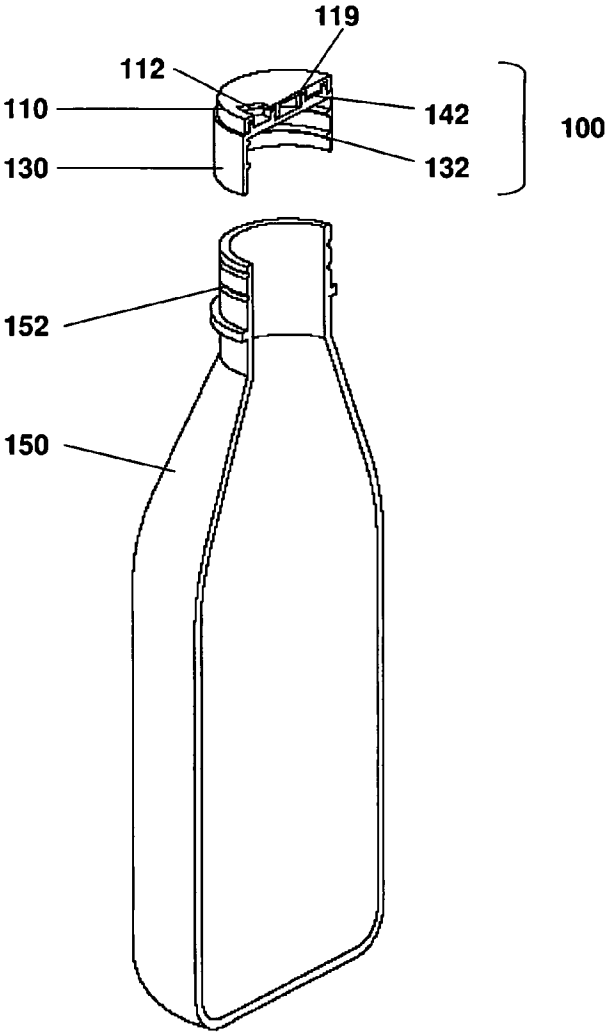
FIG. 2 shows a side cutaway view of a cap and bottle used in an embodiment of the invention.

FIG. 2 shows a side cutaway view of a cap and bottle used in an embodiment of the invention. In this figure, the threads 132 of the cap are visible, as well as pits 142 which may display various indicia such as colors, numbers, letters, shapes, or symbols.

Figure 3:
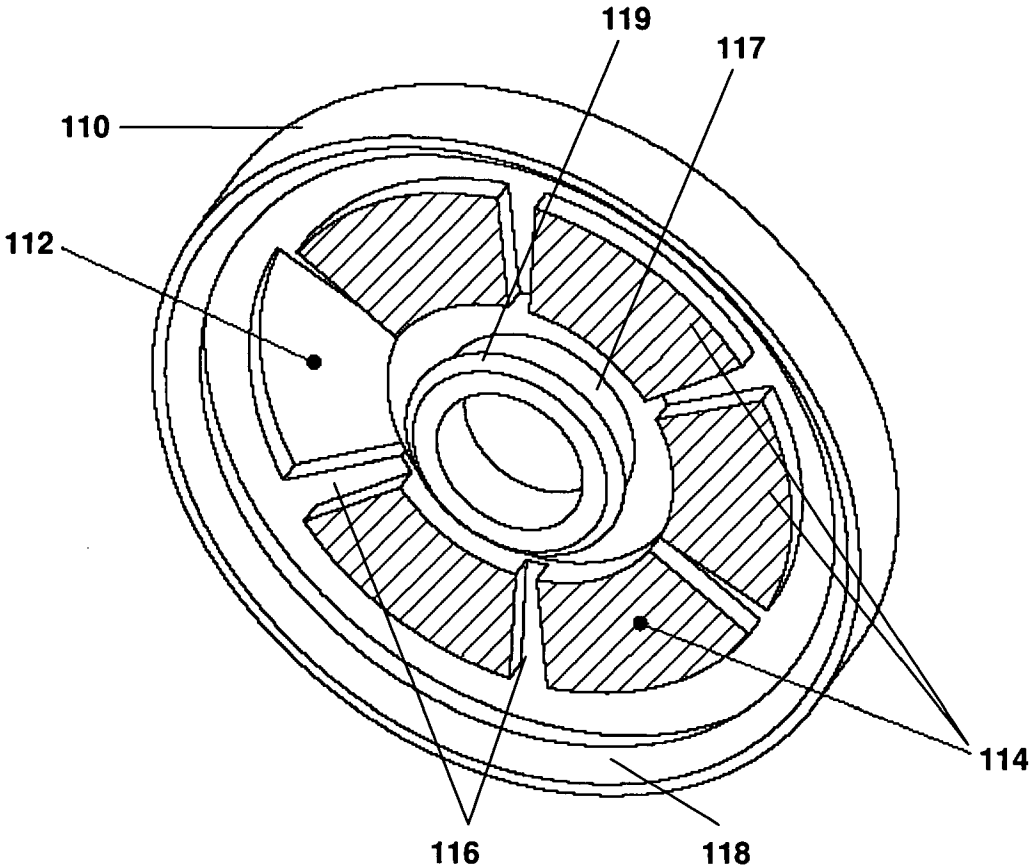
FIG. 3 shows a bottom perspective view of a first member of a cap used in an embodiment of the invention.

FIG. 3 shows a bottom perspective view of a first member of a cap used in an embodiment of the invention. The first member 110 is situated above the second member 130 in embodiments of the invention. The first member 110 comprises the aperture 112 as well as various alternating wedges 114 and grooves 116. In the embodiment of FIG. 3, five wedges 114 are present along with the aperture 112 in a trapezoidal shape having the same size as each wedge. The wedges 114 protrude outwardly from a side of the cap 110 which is adjacent to the second member 130. In embodiments of the invention, any number of reasonable wedges 114 with grooves 116 situated between them may be used.

The aperture 112 may be any reasonable size, as long as a user can recognize indicia exhibited there throughout. The aperture 112 may also protrude outwardly from the adjacent side of the cap 110 to form a wedge. The aperture 112 may be transparent or translucent and may comprise a cutout portion of molding of the first member 110 or a see-through plastic, glass, or polymer. Still further, in an embodiment of the invention, the aperture 112 magnifies indicia.

The first member 110 comprises an inner ring 119 and an outer ring 118. The inner ring 119 extends from the adjacent side of the first member 110. In this application, the adjacent side of the first member 110 refers to the generally long, flat side of the first member which faces toward the second member 130. The adjacent side of the first and second members refers to the generally long, flat side of the members exposed to or facing toward the other member. Further, the lip of a member refers to a generally perpendicular extension from an adjacent side, forming a unitary structure with the adjacent side. The inner ring 119 extends along neck 117 from a central region of the first member 110, as generally shown in FIG. 3. The outer lip 118 extends from the outer portion of first member 110 as generally shown in FIG. 3. The neck 117 beneath inner ring 119 causes the inner ring 119 to be extended further from the generally flat portion of the first member 110 than from the outer lip 118. The reason for this will become clearer later.

Figure 4:
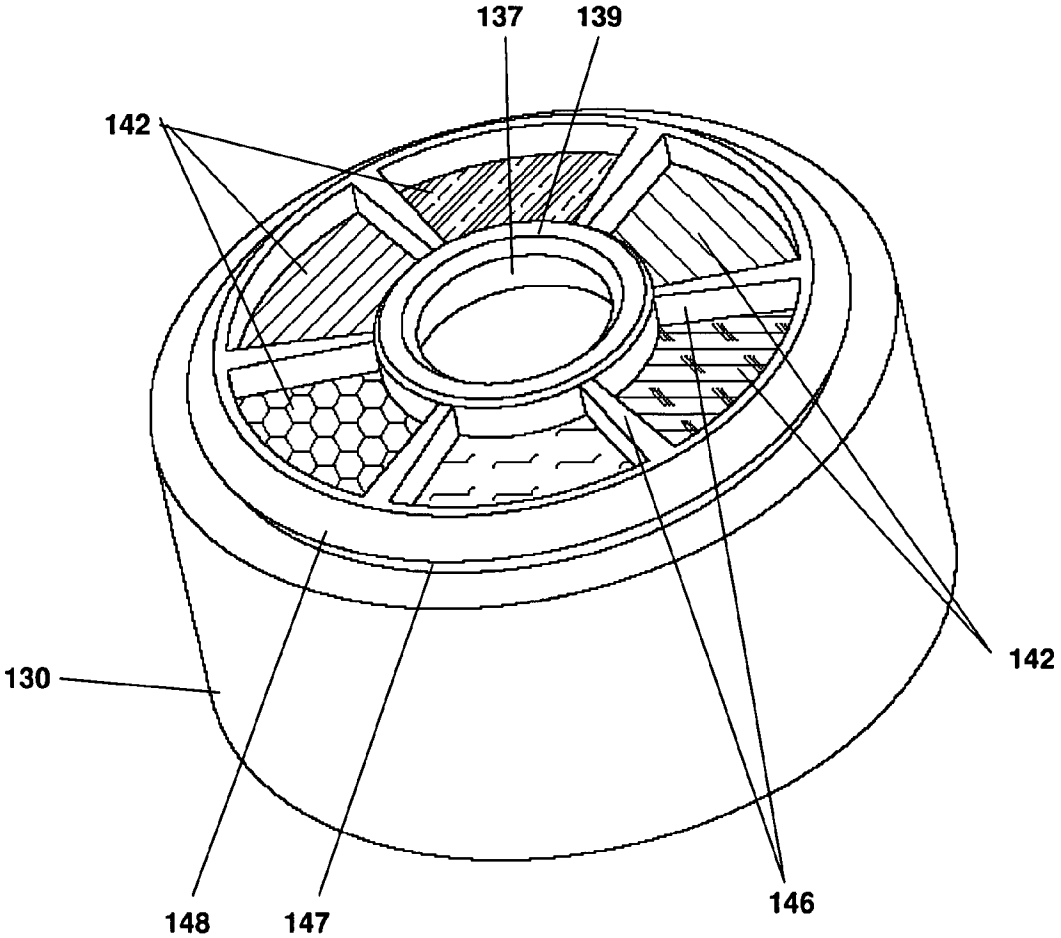
FIG. 4 shows a top perspective view of a second member of a cap used in an embodiment of the invention.

FIG. 4 shows a top perspective view of a second member of a cap used in an embodiment of the invention. The second member 130 comprises spaced-apart vanes 146 adapted for engagement with grooves 115 of the first member 110. Similarly, pits 142, which are formed from the respective spaces between the vanes, inner ring 139, and outer lip 148, are adapted for engagement with wedges 114. The outer lip 148 is raised from the base of the second member 130 on the adjacent side thereof (again, meaning adjacent to the first member) by a neck 147. In the present embodiment of the invention, one indicium is depicted or placed in each pit 142, and the aperture 112 is adapted for display of the entire indicium or a plurality, thereof. In this embodiment, the indicia are colors, each color being designated by a different pattern in the black and white figures. In another embodiment of the invention, part of an indicium or multiple indicia may be displayed through the aperture 112.

Inner ring 139 extends away from the adjacent side of the second member 130 towards the first member 110 for engagement with the inner ring 119 of the first member 110. In the first configuration of the device, such as the cap displayed in FIG. 1, the first member 110 and second member 130 are interlocked via the inner rings 119 and 139 which "overlap" each other. Inner ring 139 rotates about neck 117 and inner ring 119 simultaneously rotates about the neck of inner ring 139. In this manner, in the first configuration of the device, a user may rotate the first member 110 around the second member 130 or vice versa.

FIGS. 5A, 5B, 6A, and 6B show the method of selecting an indicium and changing the device of the first configuration, wherein the first member 110 is rotatable about the second member 120 and the second configuration, where the device irreversibly displays a selected indicium.

Figure 5A:
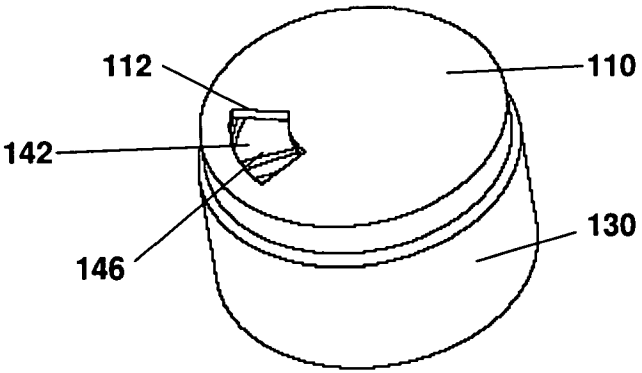
FIG. 5A shows a top perspective view of a cap in a non-lockable state as used in an embodiment of the invention.
Figure 5B:
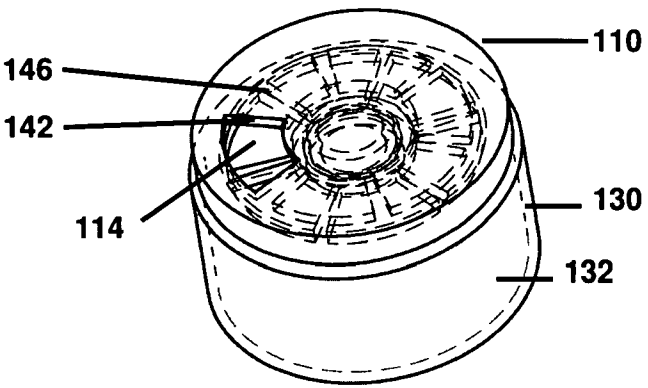
FIG. 5B shows a top perspective skeletal view of the cap of FIG. 5A.

FIG. 5A shows a top perspective view of a cap in a non-lockable state as used in an embodiment of the invention, and FIG. 5B shows a skeletal view of the cap of FIG. 5A. In embodiments of the invention, the device is shipped, packaged, and sold in this manner, and the indicia are misaligned to prevent unwanted selection of indicia. Through the aperture 112, a vane 146 and part of two pits 142 comprising indicia are visible. From the skeletal view of FIG. 5B, it can be seen that the wedges 114 are not aligned with the pits 142. Further, the vanes 146 are not aligned with the grooves 116 (not labeled, for increased clarity). In order for the device to enter into the second configuration, the wedges/pits and vanes/grooves must first be aligned, or the wedges 114 will be situated above the vanes 146, such that the first member 110 cannot be pushed/moved closer to the second member 130 in such a manner as to press the outer lip 118 of the first member 110 beneath the outer lip 148 of the second member 130. Thus, the first member 110 remains rotatable about the second member 130.

Figure 6A:
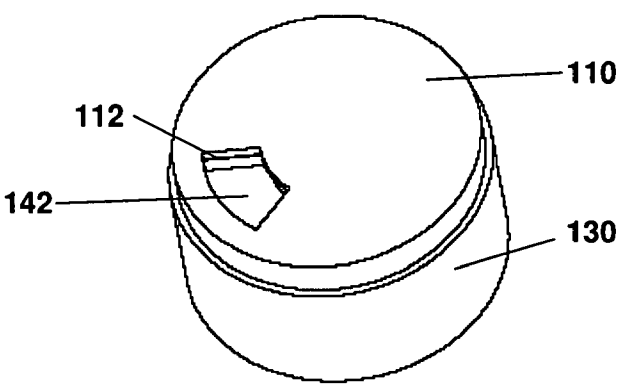
FIG. 6A shows a top perspective view of a cap in a lockable state as used in an embodiment of the invention.
Figure 6B:
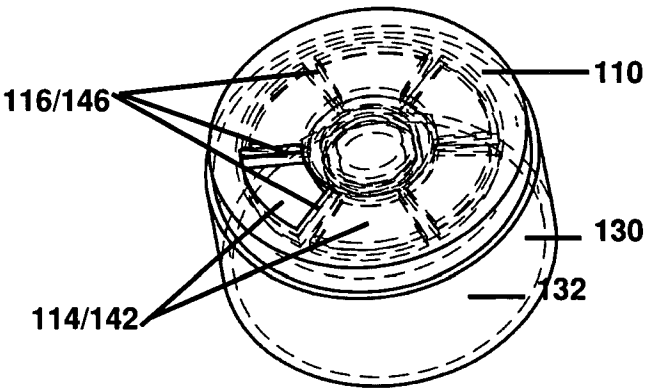
FIG. 6B shows a top perspective skeletal view of the cap of FIG. 6A.

However, moving on to FIG. 6A, showing a top perspective view of a cap in a lockable state as used in an embodiment of the invention and FIG. 6B, showing a skeletal view of same, the device in the first configuration may enter the second configuration. Through aperture 112 a single pit 142 is exhibited (or, in embodiments of the invention, a part of a single pit 142) comprising an indicium or part thereof. Wedges 114 of the first member 110 and pits 142 of the second member 130 are lined up, as well as vanes 116 and pits 146 of the respective members. As such, the device is in a condition whereby, upon applying pressure on an opposing side (with respect to one member in reference to the other member) by one member toward another member, the members 110 and 130 may be moved closer together without interference of the vanes 116 or wedges 114 (i.e., the vanes and wedges will not make contact with one another, but rather can move past each other).

FIGS. 7A-7D show the device in the first configuration, while FIGS. 8A-8D show the device in the second (locked) configuration). The device and method of modifying the device from the first configuration to the second configuration, as well as the method for causing the device to remain locked in the second configuration, will be now be described in detail.

Figure 7C:
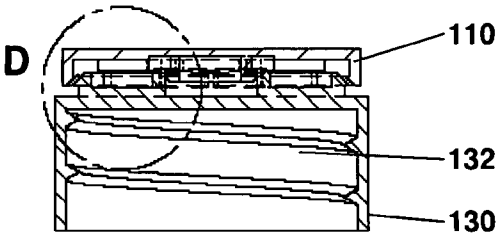
FIG. 7C shows a side cutaway view of a cap in an unlocked state as used in embodiments of the invention along section line C-C of FIG. 7B.
Figure 7D:
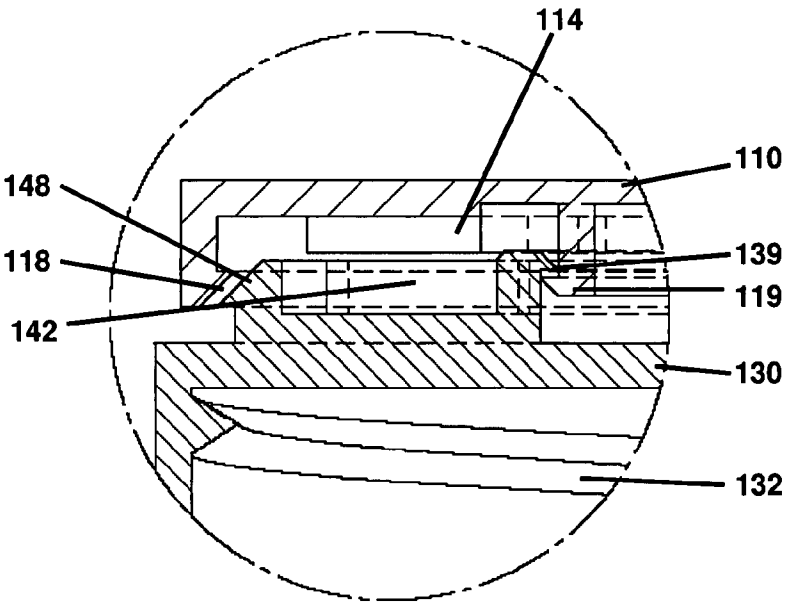
FIG. 7D shows insert D of FIG. 7C.
Figure 7A:
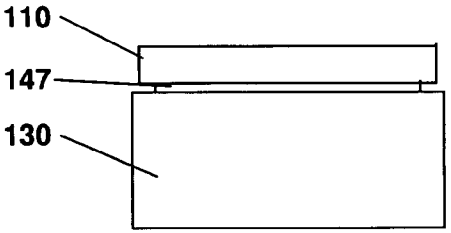
FIG. 7A shows a side plan view of a cap in an unlocked state as used in embodiments of the invention.
Figure 7B:
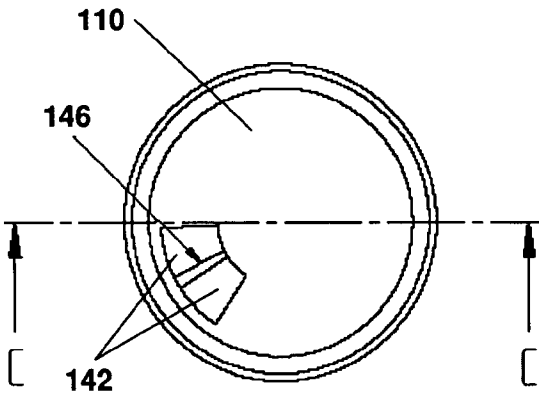
FIG. 7B shows a top plan view of a cap in an unlocked state as used in embodiments of the invention.

FIG. 7A shows a side plan view of a cap in an unlocked state as used in embodiments of the invention, and FIG. 7B shows a top plan view of a cap in an unlocked state as used in embodiments of the invention. In the first configuration, the unlocked state, first member 110 and second member 130 are visible, as well as part of neck 147 of the first member. In embodiments of the invention, neck 147 is generally cylindrical and forms a unitary structure with a generally cylindrical and hollow base region, with a corkscrew, having an opening on one side, being configured for engagement with a bottle via the corkscrew, and the outer ring 148 of the first member 110. In embodiments of the invention, neck 147 is not visible in this side plan view; however, the first member 110 may be freely rotated around the second member 130. Referring back to FIGS. 3 and 4, in this first configuration, as depicted in FIGS. 7A through 7D, the outer ring 148 of the second member 110 is situated beneath the outer ring 118 of the first member 110.

In this manner, the first and second members may be rotated with respect to one another. However, the inner ring 119, extending from neck 117 of the first member 110, and the inner ring 139, extending from neck 137 on the second member, are interlocked. This is achieved because the respective rings, 119 and 139, form a unitary structure with their respective members 110 and 130, but extend inward or outward from the necks to form a ring or tooth to be interlocked with the ring or tooth of the other member. In the embodiments of FIGS. 3 and 4, neck 117 extends from the generally elongated (planar) surface of the adjacent side of the first member 110 and is terminated at the inner ring 119 which extends substantially (within a tolerance level acceptable in the art) perpendicularly or perpendicularly outwards from the shaft of the neck 117 to form the tooth or inner ring 119. Conversely, inner ring 139 of the second member 130 terminates the neck 137 rising from the adjacent side of the second member and extends substantially perpendicularly or perpendicularly outwards from the shaft of the neck. These inner rings or teeth 119 and 139 interlock with each other in the first configuration of the device. As such, a user of the device may rotate the first and second members with respect to each other about the necks to select the indicium to be displayed through aperture 112. Still further, the inner neck 137 is substantially longer than the neck of outer ring 118, so that inner rings 119 and 139 are interlocked in the first configuration while outer rings remain unlocked. In this manner, the first member 110 and second member can be rotated freely about each other while being connected by the teeth/rings of their respective inner rings which extend perpendicularly to the respective necks.

FIG. 7B shows a top plan view of a cap in an unlocked state as used in embodiments of the invention. FIG. 8B shows a top plan view of a cap in a locked state as used in embodiments of the invention. In the unlocked state, a plurality of indicia may be viewable through the aperture 112. In FIG. 7B, two pits 142 are visible on either side of a vane 146. Referring to FIG. 7B as well as FIG. 5B, when a vane 146 is positioned adjacent to (above) a wedge 114, the device cannot enter into the second configuration, because the wedge/vane combination substantially prevents the first member 110 from moving closer to the second member 130. In this context, "substantial" means that the device cannot be locked and/or the wedge (s) 114 cannot enter the pit(s) 142. In FIG. 8B, however, a single pit 142 having an indicium is shown through the aperture 112, and the device can enter the second configuration by applying pressure against either or both the first member 110 and/or second member 130 in the direction of the respective other member. The wedge(s) 114 are lined up with the pit(s) 142 and the vane(s) 146 fit within the groove(s) 116.

FIG. 7C shows a side cutaway view of a cap in an unlocked state as used in embodiments of the invention along section line C-C of FIG. 7B. FIG. 7D shows insert D of FIG. 7C. Corkscrew 132 of the second member 132 is configured to engage with a corresponding corkscrew of a bottle, as is known in the art, to attach a cap to a bottle. Referring now to FIG. 7D, the inner necks terminate at inner rings 119 and 139. The ledges of the inner rings, the perpendicularly extending regions thereof, form teeth which frictionally engage one another to prevent detachment of the first member 110 from the second member 130 in the first configuration. However, the outer rings 118 and 148 are not engaged and the wedge(s) 114 are situated above the vane(s) 146 (shown as a dotted line) and pit(s) 142. Thus, in the first configuration, the inner rings 119 and 139 for teeth connect the first member 110 to the second member 130 and allow rotational movement of the members with respect to each other.

Figure 8C:
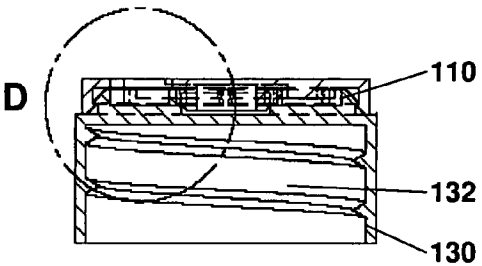
FIG. 8C shows a side cutaway view of a cap in a locked state as used in embodiments of the invention along section line C-C of FIG. 8B.
Figure 8D:
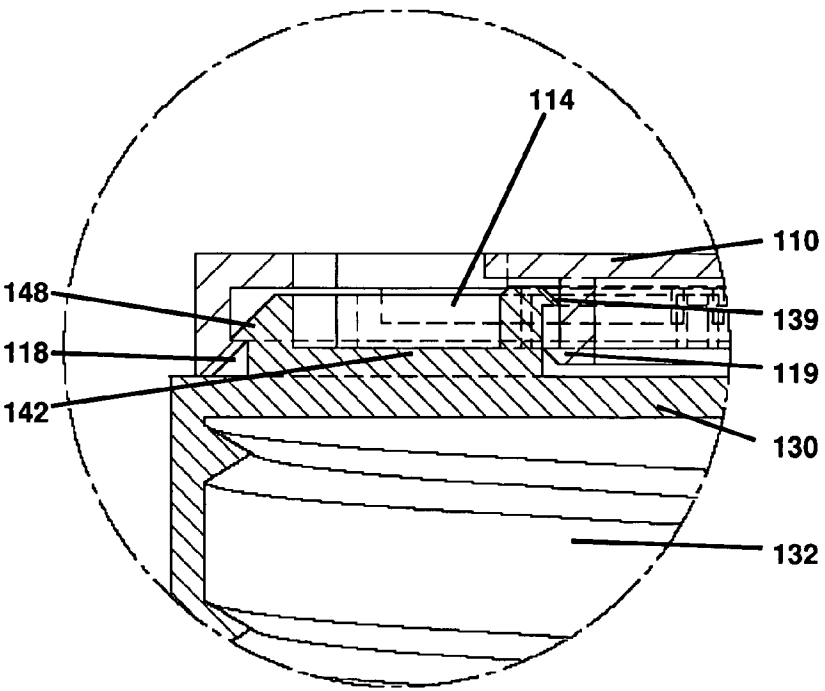
FIG. 8D shows insert D of FIG. 8C.
Figure 8A:
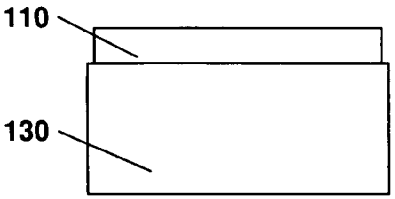
FIG. 8A shows a side plan view of a cap in a locked state as used in embodiments of the invention.
Figure 8B:
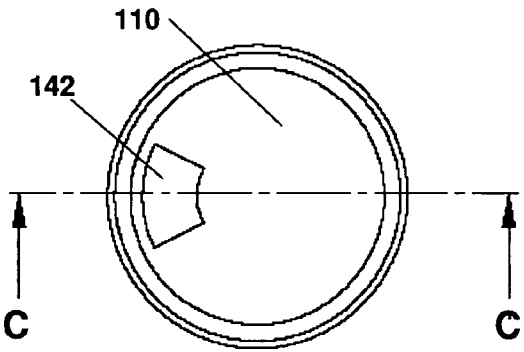
FIG. 8B shows a top plan view of a cap in a locked state as used in embodiments of the invention.

FIG. 8C shows a side cutaway view of a cap in a locked state as used in embodiments of the invention along section line C-C of FIG. 8B. FIG. 8D shows insert D of FIG. 8C. FIG. 8C is substantially similar to FIG. 7C, except that the device is in the second configuration. Inner rings 139 and 119 continue to provide frictional attachment between the first member 110 and second member 130, but they have moved apart or past each other as the members have been pushed toward each other, and wedge(s) 114 are situated in pit(s) 142 and vane(s) 146 are situated in groove(s) 116. Thus, referring again to FIGS. 3 and 4, it should be apparent to one having ordinary skill in the art that the wedge/pit and vane/groove combination prevents rotational movement of the first and second members with respect to each other, because the rigid vanes 146 and wedges 114 abut one another.

Still further, referring to FIG. 8D, a specific, outer ring 118 forms a circular tooth-like structure which frictionally engages with outer tooth 148. The tooth-like projection of ring 148 extends perpendicularly outwards relative to its neck and base forming a lip. When the first and second members 110 and 130 are pressed towards each other, the outer ring 118 moves past the tooth-like projection of the outer ring 148. This movement irreversibly causes the second configuration to be entered, as the flat, perpendicular side of the tooth of the outer ring 148 prevents movement of the first member 110 up or away from the second member 130. Thus, the device is irreversibly, or all but irreversibly, placed into the second configuration.

Referring again to FIGS. 6A and 8B, a single pit 142 or single indicium is displayed in the second, locked configuration. Thus, since the device cannot be returned to the first position without a substantial (beyond reasonable) use of force that would likely damage the device, the indicium exhibited under the aperture 112 is substantially permanent (i.e., what a reasonable person would expect the normal duration of usage of the item to be).

Figure 10:
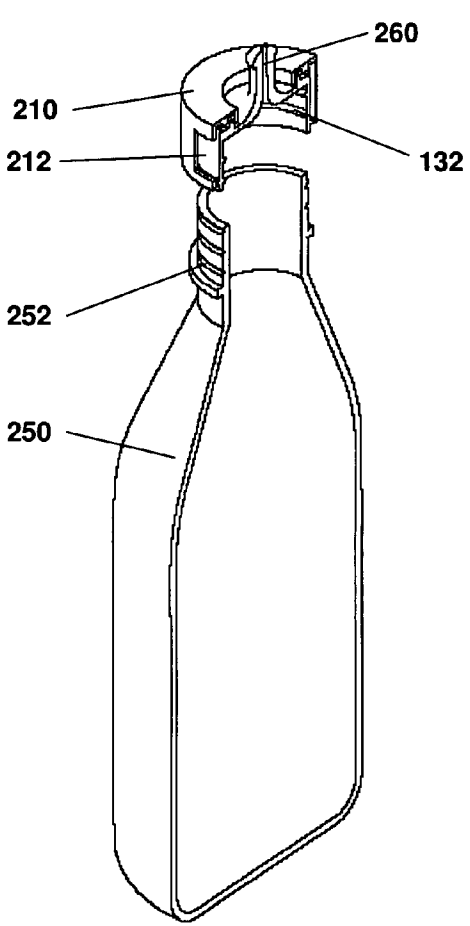
FIG. 10 shows a side cutaway view of a cap and bottle used in a second embodiment of the invention.
Figure 9:
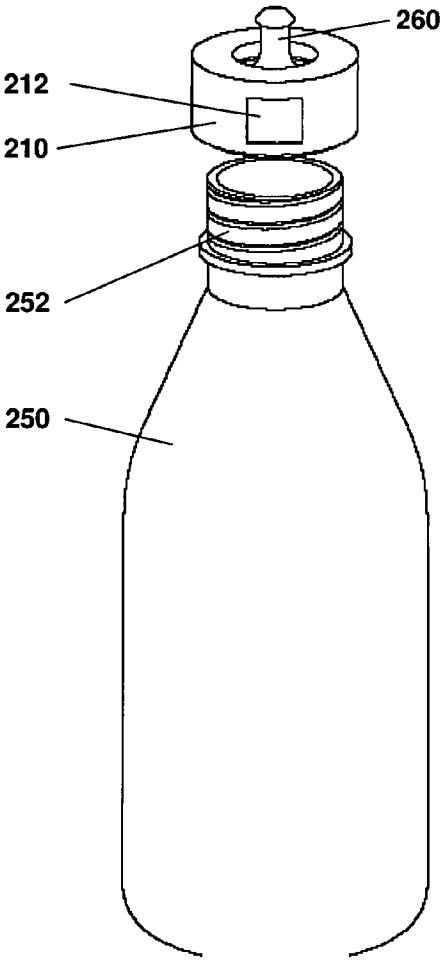
FIG. 9 shows a side elevation view of a cap and bottle used in a second embodiment of the invention.

FIG. 9 shows a side elevation view of a cap and bottle used in a second embodiment of the invention. FIG. 10 shows a side cutaway view of a cap and bottle used in a second embodiment of the invention. The figure labels have generally been incremented by 100 compared to the figure labels for the embodiment shown in FIGS. 1-8D. Thus, second member 130 is now second member 230, and so forth. This second embodiment is generally applicable to caps which provide drinking apparatuses or devices which otherwise have an aperture 212 on the side for viewing of indicia. The mechanism of the device of this embodiment functions similarly to the mechanism of the device of the previously described embodiment; however, the first member 210 comprises a perpendicularly extending region with respect to the base of the member, wherein the aperture 212 exhibits indicia placed around the circumference of the second member 230, and the indicia 244 have been separated from the pits 242.

Referring again to FIGS. 9 and 10, a sucking flange 260 is provided on a second member 230 (see FIG. 12) and extends substantially above the plane of the first member 210 and second member 230. The sucking flange 260 comprises a hollow central region for movement of fluid from a receptacle 250 to the mouth of a user. In an alternative embodiment, the sucking flange 260 is a portal.

Figure 11:
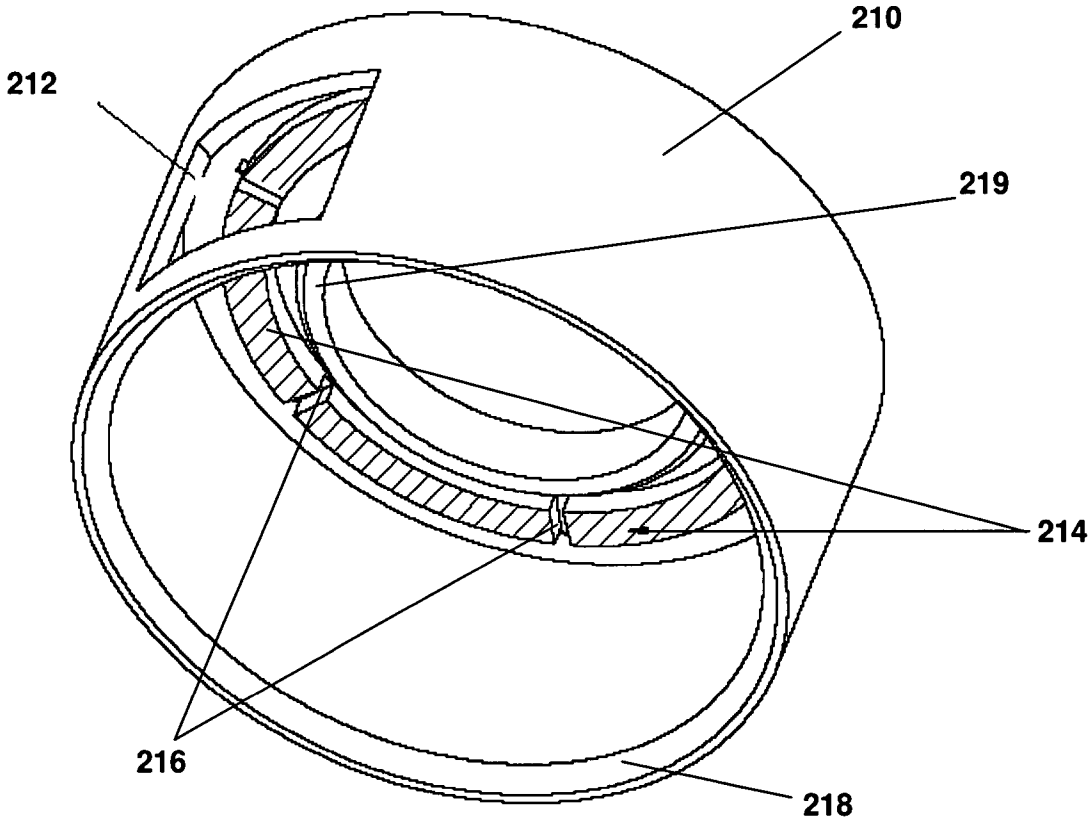
FIG. 11 shows a bottom perspective view of a first member of a cap used in a second embodiment of the invention.

FIG. 11 shows a bottom perspective view of a first member of a cap used in a second embodiment of the invention. The first member 210 comprises wedges 214 and grooves 216 situated there between. An aperture 212 allows a user to view indicia exhibited on the second member 230. An inner ring 219 generally engages an inner ring 239 (see FIG. 12) of the second member 230, and an outer ring 218 is also provided which engages an outer ring 240 (see FIG. 12) of the second member in the second configuration, but not the first configuration of the device.

Figure 12:
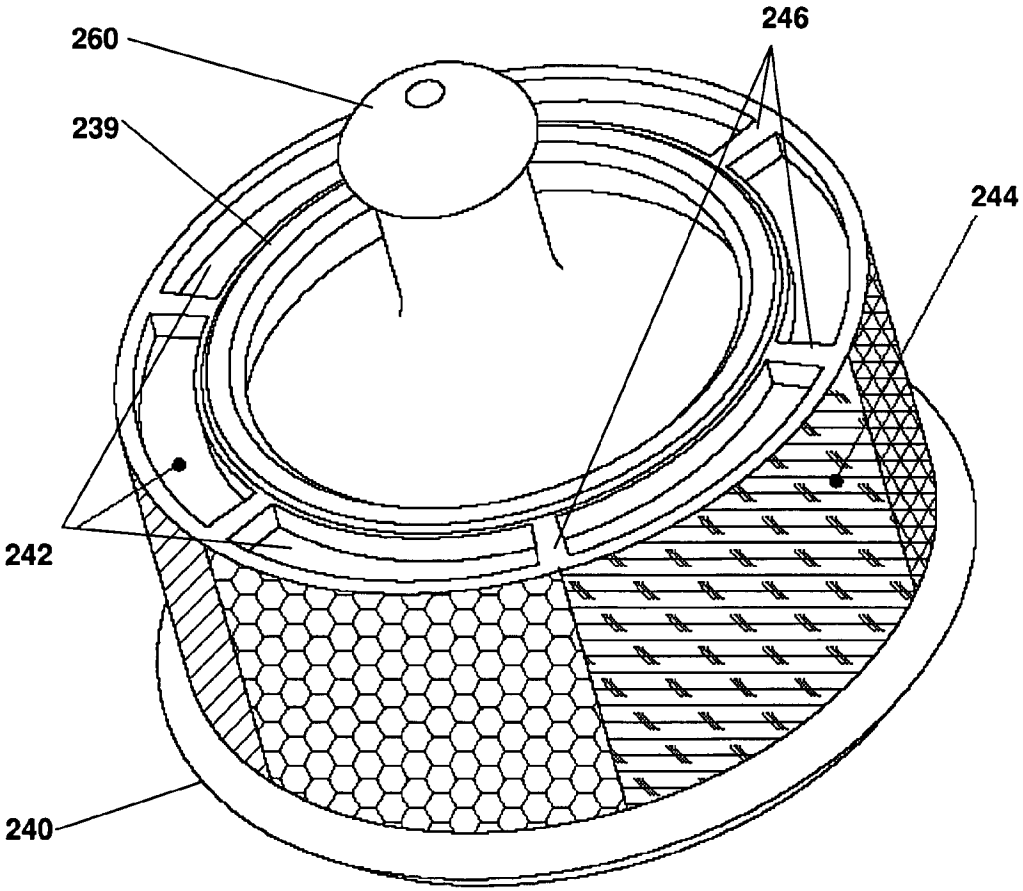
FIG. 12 shows a top perspective view of a second member of a cap used in a second embodiment of the invention.

FIG. 12 shows a top perspective view of a second member of a cap used in a second embodiment of the invention. Vanes 246 are interspaced between pits 242 on the adjacent (top) side of the second member 230. Indicia 244 are exhibited around the circumference of the device as shown in the figure, and divided into sections corresponding to each vane 246 in such a manner that an indicium 244 (or plurality of indicia) is associated with each pit 242. In this manner, referring also to FIG. 11, when the aperture 212 (which corresponds in location around the circumference of the first member 210 with a single wedge 214) displays a single indicium 244, the device may enter the second configuration from the first configuration as the grooves/vanes and wedges/pits will match each other.

The outer rings 218 of the first member 240 and of the second member 230 function similarly to the other rings of the devices described, in that the rings terminate a neck extending from the adjacent side of a member and comprise a flat underside and a tooth-like projection with a slanted top side (i.e., adjacent to the other member) for moving past another ring, the ring extending the circumference of the member.

Figure 13B:
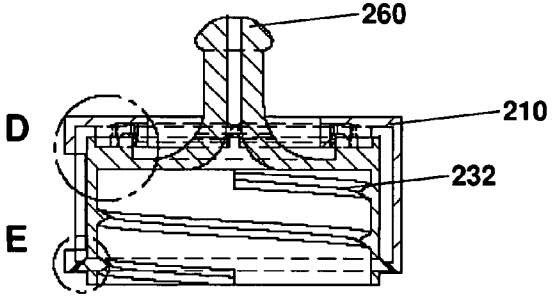
FIG. 13B shows a side cutaway view of a cap in an unlocked state as used in a second embodiment of the invention along section line B-B of FIG. 13C.
Figure 13A:
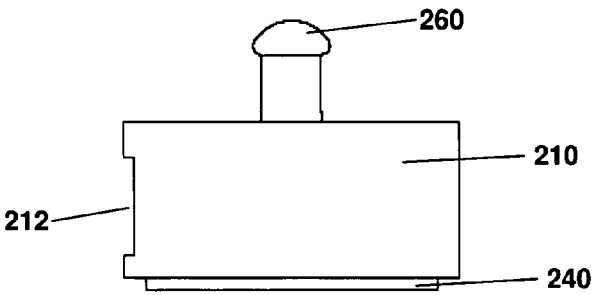
FIG. 13A shows a side plan view of a cap in an unlocked state as used in a second embodiment of the invention.
Figure 13D:
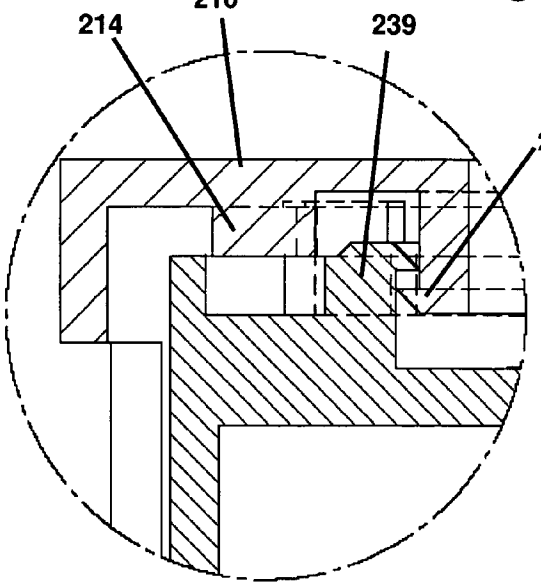
FIG. 13D shows insert D of FIG. 13B
Figure 13E:
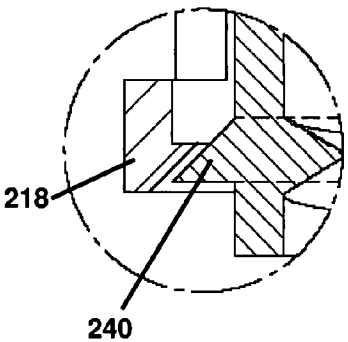
FIG. 13E shows insert E of FIG. 13B.
Figure 13C:
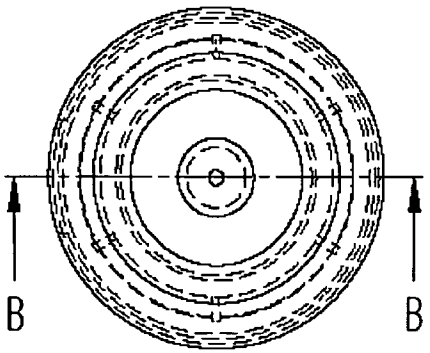
FIG. 13C shows a top plan view of a cap in an unlocked state as used in a second embodiment of the invention.

FIG. 13A shows a side plan view of a cap in an unlocked state as used in a second embodiment of the invention. FIG. 13B shows a side cutaway view of a cap in an unlocked state as used in a second embodiment of the invention along section line B-B of FIG. 13C. FIG. 13C shows a top plan view of a cap in an unlocked state as used in a second embodiment of the invention. FIGS. 13D and 13E correspond to the respective insets of FIG. 13B. In the locked state, outer ring 240 of the second member is visible in embodiments of the invention. The first member 210 may be rotated around the second member 230. Inner rings 239 and 219 are interlocked via the tooth-like projections of the rings and rotatably attach the first and second members 210 and 230. The wedge(s) 214 are situated above the pits 242 and vanes 246 such that rotational movement of one member about the other is uninhibited. Still further, referring especially to FIG. 13E, the outer ring 218 is situated above the outer ring 240 in such a manner that the teeth/rings are unlocked (i.e., in the first configuration).

Figure 14B:
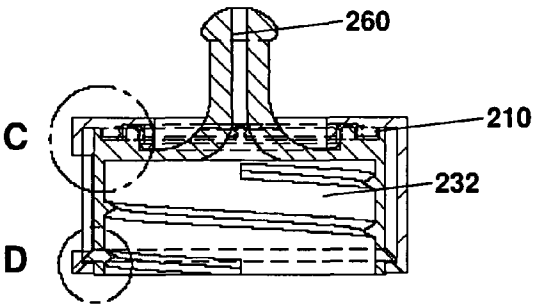
FIG. 14B shows a side cutaway view of a cap in a locked state as used in a second embodiment of the invention along section line B-B of FIG. 13C.
Figure 14D:
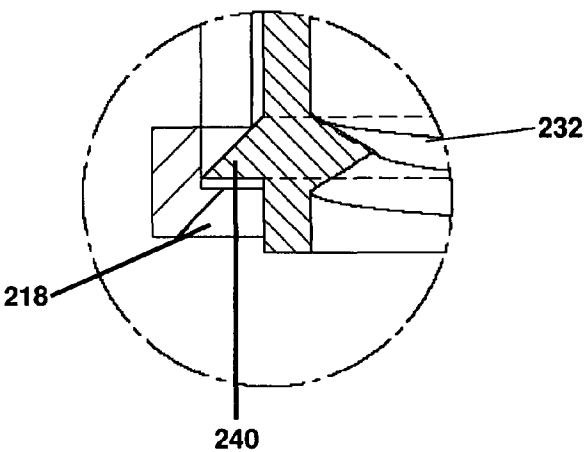
FIG. 14D shows insert D of FIG. 14B.
Figure 14A:
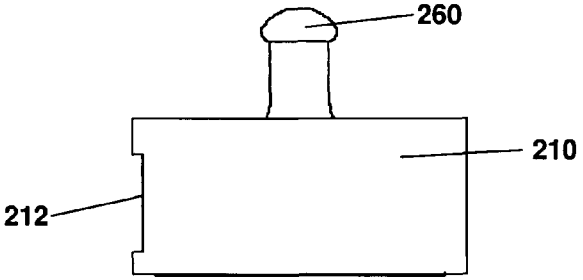
FIG. 14A shows a side plan view of a cap in a locked state as used in a second embodiment of the invention.
Figure 14C:
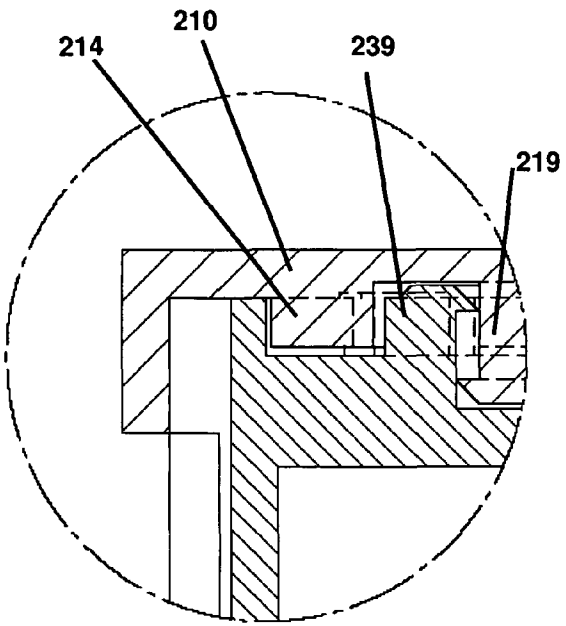
FIG. 14C shows insert C of FIG. 14B.

FIG. 14A shows a side plan view of a cap in a locked state as used in a second embodiment of the invention. FIG. 14B shows a side cutaway view of a cap in a locked state as used in a second embodiment of the invention along section line B-B of FIG. 13C. FIG. 14C shows insert C of FIG. 14B. FIG. 4D shows insert D of FIG. 14B. In this second configuration of the device, the wedge(s) 214 are situated within the pit(s) 242 and indicium 244 (or set of indicia 244), corresponding to a wedge/pit exhibited through aperture 212. Referring now specifically to FIG. 14D, the outer rings 218 and 240 are interlocked, in that each ring is connected to a respective member and the teeth of each ring 218 and 248 are positioned past each other, causing frictional, and substantially (in excess of reasonable force normally exerted on a bottle cap) irreversible, engagement between the first and second members 210 and 230.

In other embodiments of the invention, pits 142 or 242 may be reversed with wedges 114 and 214. That is, the pits may be placed on the first member 110 or 210, and the wedges may be placed on the second member 130 or 230. In such embodiments of the invention, in the second configuration, a wedge with indicia may be positioned through the aperture 112, and hidden indicia may be placed on the sides of the wedges, which will only be exhibited in the second configuration when a wedge passes through the aperture. In yet another embodiment of the invention, multiple sets of indicia or combinations thereof may be displayed through a plurality of apertures. A third member, fourth member, and so on, comprising pits/wedges and toothed-rings or other methods of attachment and allowing/preventing rotational movement may be used to provide selection and exhibiting of multiple indicia. For example, a first indicium may be displayed at the side of a device similar to the second embodiment of the invention, and a second indicium may be displayed on a top portion of the device. Combinations of these embodiments are also contemplated as being within the scope and spirit of the invention disclosed herein.

Figure 15:
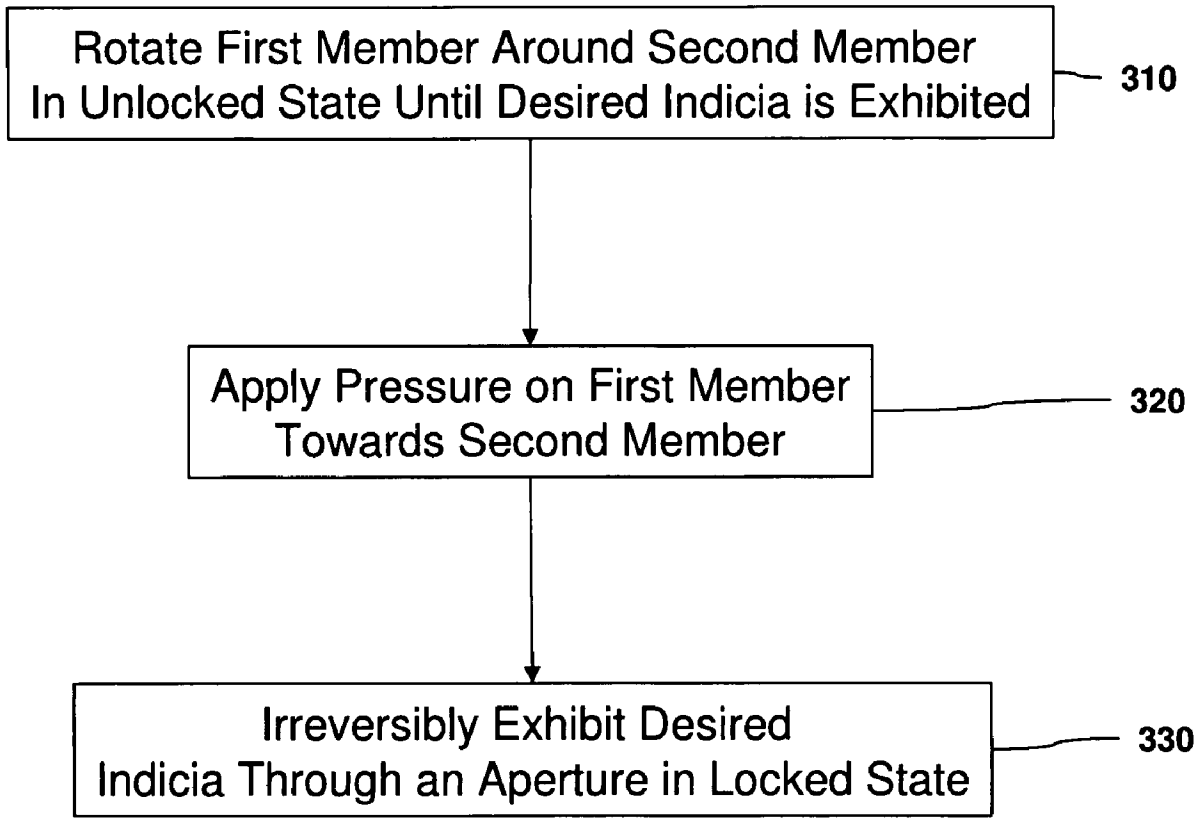
FIG. 15 shows the steps used to carry out the method in an embodiment of the invention.

FIG. 15 shows the steps used to carry out the method in an embodiment of the invention. In step 310, a user of the device rotates a first member having a display aperture around a second member with a plurality of indicia. The device may be one such as that described in any of FIGS. 1-14. Upon exhibiting the desired indicia through the aperture, in step 320 the user applies pressure on the first member in the direction of the second member (or vice versa), in order to cause the members, in step 330, to clamp together and irreversibly exhibit the desired indicia through the aperture in a locked state of the device. In embodiments of the invention, the user must apply a degree of force greater than would ordinarily be exerted on the device during shipping or common usage thereof. In this manner, unwanted clamping of the members is avoided.

While the invention has been taught with specific reference to the above embodiments, a person having ordinary skill in the art will recognize that changes can be made in form and detail without departing from the spirit and the scope of the invention. The described embodiments are to be considered in all respects only as illustrative and not restrictive. All changes that come within the meaning and range of equivalency of the claims are to be embraced within their scope.

I claim:

1. A cap having at least a first and second member, each said first and second member having an adjacent side and an opposing side with respect to said other member, said cap having a first configuration in which said first and second members are rotatably connected to each other and a second configuration in which said first and second members are fixed to each other, wherein the cap enters said second configuration by pressure being applied against said first member in the direction of said second member, and said first member further comprises at least one circular lip configured for substantially irreversible engagement with said second member, such that said second configuration is substantially irreversible.

2. The cap of claim 1, wherein said lip comprises a region substantially parallel to said second member causing said cap in said second configuration to remain in said second configuration.

3. The cap of claim 1, wherein said second member further comprises a plurality of indicia on said adjacent side and said first member comprises an aperture extending through said first member, said aperture opening to at least a part of one said indicium.

4. The cap of claim 3, wherein said indicia are colors and said exhibited indicium is a color.

5. The cap of claim 3, wherein at least said first member comprises a perpendicularly extending lip and said lip comprises said aperture.

6. The cap of claim 1, wherein said adjacent side of said first member further comprises a plurality of protruding wedges spaced apart by a plurality of grooves.

7. The cap of claim 6, wherein said adjacent side of said second member further comprises a plurality of pits spaced apart by a plurality of vanes substantially corresponding to said wedges and grooves of said first member.

8. The cap of claim 7, wherein said second configuration is substantially irreversibly engaged upon pressing said wedges into said pits and said grooves into said vanes.

9. A cap for irreversibly exhibiting one of a plurality of indicia, said cap comprising first and second members, each said first and second member having an adjacent and an opposing side with respect to said other member, said second member comprising a plurality of indicia on said adjacent side, said first member comprising an aperture adapted for exhibiting one said indicium, said cap comprising a first configuration wherein said first and second members are rotatably connected to each other;

wherein said cap is adapted to enter said second configuration by pressure being applied against said first member in the direction of said second member, causing a substantially irreversible fixed attachment between said first and said second members to each other, and, in said second configuration, one said indicium is exhibited through said aperture.

10. The device of claim 9, wherein said device comprises at least a part of a bottle cap.

11. The device of claim 9, wherein said first member comprises at least one neck, said neck terminating at a tip, said tip extending substantially perpendicularly to said neck and having a flat side to cause said device to remain in said second configuration.

12. The device of claim 11, wherein said first member comprises a plurality of wedges configured for placement into a plurality of corresponding pits of said second member as said device enters said second configuration.

13. The device of claim 12, wherein said plurality of wedges and said plurality of corresponding pits are aligned in a manner such that in said second configuration said first member and said second member are fixed with respect to each other and one indicium is exhibited through said aperture.

14. A method of selecting an irreversibly displayed indicium comprising the steps of:

rotating a first member until a desired indicium is exhibited through an aperture in said first member;

applying pressure on said first member toward said second member;

wherein said first member and said second member become substantially irreversibly locked in place and one indicium on said second member is exhibited through an aperture of said first member.

15. The method of claim 14, wherein said indicia are colors and said exhibited indicium is a single color.

16. The method of claim 14, wherein said method is carried out on a bottle cap.

17. The method of claim 14, wherein a tooth extending from said first member beneath said second member causes said device to remain in said second configuration.

18. The method of claim 14, wherein said first member comprises a perpendicularly extending lip and said aperture is on said lip.

19. The method of claim 18, wherein said second member comprises a perpendicularly extending lip and said indicia are on said lip.

* * * * *